US005399468A

United States Patent [19]

Sawyer et al.

[11] Patent Number: 5,399,468

[45] Date of Patent: Mar. 21, 1995

[54] COLOR PHOTOGRAPHIC SILVER HALIDE DUPLICATING ELEMENT AND PROCESS

[75] Inventors: John F. Sawyer; David E. Fenton, both of Fairport, N.Y.

[73] Assignee: Eastman Kodak Company, Rochester, N.Y.

[21] Appl. No.: 108,152

[22] Filed: Aug. 17, 1993

Related U.S. Application Data

[63] Continuation of Ser. No. 631,541, Dec. 21, 1990, abandoned.

[51] Int. Cl.[6] ..... G03C 7/333; G03C 7/36

[52] U.S. Cl. ..... 430/504; 430/359; 430/505; 430/506; 430/557; 430/559; 430/563

[58] Field of Search ..... 430/359, 557, 558, 504, 430/549, 559, 561, 562, 563, 505, 506

[56] References Cited

U.S. PATENT DOCUMENTS

| | | | |
|---|---|---|---|
| 2,808,329 | 10/1957 | Whitmore | 430/359 |
| 4,229,525 | 10/1980 | Ueda | 430/568 |
| 4,647,527 | 3/1987 | Ikenoue | 430/359 |
| 5,053,324 | 10/1991 | Sasaki | 430/504 |

*Primary Examiner*—Lee C. Wright
*Attorney, Agent, or Firm*—Gordon M. Stewart

[57] ABSTRACT

A color photographic silver halide negative working duplicating element and process comprising (A) a magenta colored masking coupler in at least one blue-sensitive photographic silver halide emulsion layer; and (B) a combination of (i) masking couplers and (ii) color contamination of at least one photographic silver halide emulsion layer enables upon exposure and processing of the element formation of a duplicate image that enables formation of a print image that is visually indistinguishable from the original image. The color photographic silver halide duplicating element is useful in forming duplicate images, especially for color motion picture films.

10 Claims, No Drawings

COLOR PHOTOGRAPHIC SILVER HALIDE DUPLICATING ELEMENT AND PROCESS

This is a continuation of application Ser. No. 07/631,541, filed Dec. 21, 1990, now abandoned.

This invention relates to a color photographic silver halide negative working duplicating element comprising a combination of components that enables formation of a duplicate image that enables formation of a print image that is visually indistinguishable from the original image, particularly in motion picture films.

Color photographic silver halide negative working duplicating elements, especially films, have been known, especially for duplicating color motion picture films. A typical example of such a duplicating element is Eastman Color Intermediate Film manufactured and sold by Eastman Kodak Company, U.S.A.

Such a duplicating element is useful in preparing duplicates of motion picture films. Current practice for most color motion picture production involves the use of at least four photographic steps. The first step is the recording of the scene onto a camera negative photographic film. For applications using two steps this original negative is printed onto a negative working print film, producing a direct print. Most motion picture productions use an additional two steps. The original camera negative film is printed onto a negative working intermediate film, such as the described Eastman Color Intermediate Film, yielding a master positive. The master positive is subsequently printed again onto an intermediate film providing a duplicate negative. Finally, the duplicate negative is printed onto a print film forming the release print.

It has been desirable that the intermediate film produce a duplicate negative that enables a print that is visually indistinguishable in tone scale, color, graininess, and sharpness from the direct print.

None of the intermediate films available have produced such results of visually indistinguishable color reproduction. Undesired differences in color reproduction between the direct print and the release print can result from many factors. Such factors include, for example, color correction of the intermediate film, the combination of image dyes formed in the intermediate and camera negative films, and spectral sensitivities of the intermediate film and print film.

In current commercial practice, the spectral sensitivities of the intermediate film are selected to be similar to the print film. And, the combination of image dyes, also described herein as the dye set, of the intermediate film is selected to he similar to the camera negative film. This enables the intermediate film used to make a master positive to respond like a print film when printed from the camera negative film, but still produce a negative-like dye set. The intermediate film used to make a duplicate negative responds like a print to the master positive's negative-like dye, and also produces a negative-like dye set. Finally, the negative-like dye set of the duplicate negative prints properly onto print film.

The color correction of the intermediate film is selected to provide the best possible match in color reproduction between the direct print and the release print. Color correction is accomplished by means of interlayer interimage effects, masking couplers and color contamination. In current practice, it is desirable in an intermediate film to have a low level of interlayer interimage effects in order to limit color correction variations that might result as a function of exposure level. While some color contamination has been used, color correction has been accomplished mostly by use of masking couplers. However, these means for color correction have not been entirely effective to provide a fully satisfactory intermediate film for motion picture production.

Previous color negative intermediate films using color correction means have resulted in deficient color reproduction. This is a result of, for example, lack of sufficient color correction for the green density of the yellow image and lack of an optimal overall color correction position. No answer to these problems was clear from the prior art regarding photographic silver halide negative working duplicating elements.

It has been found that such advantages are provided by a color photographic silver halide negative working duplicating element for duplicating an original image comprising a support bearing at least one red-sensitive photographic silver halide emulsion layer comprising at least one cyan image-dye forming coupler that is capable upon exposure and processing of forming a cyan image dye that absorbs in the range of the original image; at least one green-sensitive photographic silver halide emulsion layer comprising at least one magenta dye-forming coupler that iscapable upon exposure and processing of forming a magenta image dye that absorbs in the range of the original image; and at least one blue-sensitive photographic silver halide emulsion layer comprising at least one yellow image dye-forming coupler that is capable upon exposure and processing of forming a yellow image dye that absorbs in the range of the original image; and at least one blue-sensitive photographic silver halide emulsion layer as described comprises at least one masking coupler;

wherein the element comprises: (A) a magenta colored masking coupler in at least one blue-sensitive photographic silver halide emulsion layer; and, (B) a combination of (i) masking couplers and (ii) color contamination of at least one of the photographic silver halide emulsion layers to enable upon exposure and processing formation of a duplicate image. The element enables formation of a duplicate image that enables formation of a print image that is visually indistinguishable from the original image.

The term formation of a duplicate image that is visually indistinguishable from the original image herein means that under typical motion picture viewing conditions the unaided human eye can see no significant differences between the images.

One of the most important features of the duplicating element as described is the enablement of accurate color reproduction upon exposure and processing. The duplicating element enables formation of a duplicate image that enables formation of a print image with colors that are visually indistinguishable from the colors of the original image.

The term negative working duplicating element herein means a photographic silver halide element, preferably a film, that does not work by means of a positive working mechanism or direct positive material. It also means that the element is designed for duplication of a color image, such as duplication of a color motion picture film, and for this purpose contains photographic silver halide emulsions that are preferably very fine grain photographic silver halide emulsions containing a grain size of less than 0.30 micron, especially a grain size within the range of 0.04 to 0.25 micron. A preferred range for cubic silver halide emulsions is 0.04 to 0.20 micron.

The layer order of the duplicating element as described can be any order that enables the duplication to provide a duplicate image that enables formation of a print image that is visually indistinguishable from the original image. The layer order is preferably one that comprises on a support, preferably a film support, in sequence, at least one cyan dye-forming layer, at least one magenta dye-forming layer and at least one yellow dye-forming layer. Preferably each of the dye-forming layers comprises a unit of layers preferably comprising one, two or three layers that have different photosensitivity and form the same or essentially the same image dye hue.

The photographic silver halide emulsions in each of the layers are comprised of very fine grain photographic silver halides, preferably silver bromoiodide. The emulsions can include silver halide grains of any conventional shape or size provided that the shape and size selected enable the duplication results as described. The emulsions preferably comprise silver bromoiodide grains that are cubic grains and/or T-grains. The T-grain photographic silver halide emulsions can be prepared by any procedure known in the photographic art for preparation of such grains. The T-grain photographic silver halide can be any of the T-grain photographic silver halides described in, for example, U.S. Pat. Nos. 4,434,226; 4,414,310; 4,399,215; 4,433,048; 4,386,156; 4,504,570; 4,400,463; 4,414,306; 4,435,501; 4,643,966; 4,672,027 and 4,693,964. The silver halide grains can be either monodisperse or polydisperse as precipitated. The grain size distribution of the emulsions can be controlled using techniques known in the photographic art.

Sensitizing compounds, such as compounds of copper, thallium, lead, bismuth, cadmium, and group VIII noble metals, can be present during the precipitation of the silver halide emulsions.

The silver halide emulsions can be surface sensitized by addenda and methods known in the photographic art. That is, the emulsions can be sensitized to form latent images primarily on the surfaces of the silver halide grains. Noble metals, such as gold, middle chalcogens, such as sulfur, selenium and tellurium, and reduction sensitizers, can be employed individually or in combinations are examples of sensitizers that are contemplated. Typical chemical sensitizers are described in Research Disclosure, Item No. 308119, December 1989, published by Kenneth Mason Publications Ltd., Dudley Annes, 12a North Street, Emsworth, Hampshire PO 107DQ, England. This publication is referred to herein as "Research Disclosure".

The silver halide emulsions are spectrally sensitized with dyes from a variety of classes, including the polymethine dye class, which includes the cyanines, merocyanines, complies cyanines, and merocyanines(ie., tri-,tetra-, and poly-nuclear cyanines and merocyanines), oxonols, hemioxonols, stryrls, merostyryls, and streptocyanines. Combinations of spectral sensitizing dyes are also useful. Illustrative sensitizing dyes are disclosed in, for example, Research Disclosure Section IV.

The emulsion layers and other layers of the duplicating element can comprise vehicles and binders known in the photographic art, such as described in Research Disclosure Section IX and the references cited therein.

In addition to the couplers described herein the elements of the invention can include additional couplers as described in Research Disclosure Section VII and the publications cited therein. These added couplers can be incorporated as described in Research Disclosure Section VII and the publications cited therein. Added couplers can include, for example, DIR and DIAR couplers known in the photographic art to provide desired interimage effects.

A preferred embodiment of the described duplicating element is one in which the green-sensitive photographic silver halide emulsion layer comprises a combination of a major proportion, that is more than 50% by weight of the total magenta couplers, of a pyrazolone magenta image-dye forming coupler and a minor proportion, that is less than 50% by weight of the total magenta couplers, of a pyrazolotriazole magenta image-dye forming coupler; and wherein the blue-sensitive photographic silver halide emulsion layer comprises an acetanlide yellow image-dye forming coupler, optionally contaminated with a minor concentration, i.e. 1.25 to 5 molar percent per mole of image forming coupler in the layer, of a phenolic image-dye forming coupler, and comprises a magenta colored masking coupler, preferably a magenta colored masking coupler as described herein.

Any cyan image-dye forming coupler, any magenta image-dye forming coupler and any yellow image-dye forming coupler that provide the desired color reproduction are useful in the described duplicating element. Combinations of such image-dye forming couplers are also useful. Preferably the duplicating element as described comprises in the red-sensitive layer a cyan image-dye forming coupler that is a phenolic or naphtholic cyan image-dye forming coupler; the green-sensitive layer comprises a magenta image-dye forming coupler that is a pyrazolone image-dye forming coupler in combination with a pyrazolotriazole magenta image-dye forming coupler; and the blue-sensitive layer comprises a pivaloylacetanilide or benzoylacetanilide yellow image-dye forming coupler.

Useful cyan image-dye forming couplers are described in, for example, such representative patents and publications as: U.S. Pat. Nos. 2,772,162; 2,895,826; 3,002,836; 3,034,892; 2,474,293; 2,423,730; 2,367,531; 3,041,236; and 4,333,999 and "Farbkuppler: Ein Literaturubersicht," published in Agfa Mitteilungen, Band III, pp. 156–175 (1961). The cyan image-dye forming couplers described in U.S. Pat. No. 4,333,999 are preferred.

Preferably such couplers are phenols and naphthols which form cyan dyes on reaction with oxidized color developing agent at the coupling position, i.e. the carbon atom in the 4- position of the phenol or naphthol. Structures of such preferred cyan coupler moieties are:

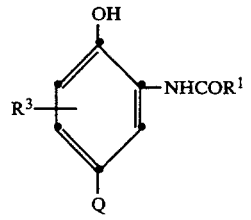

-continued

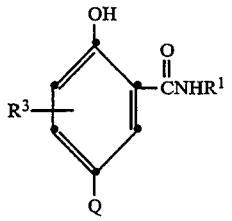

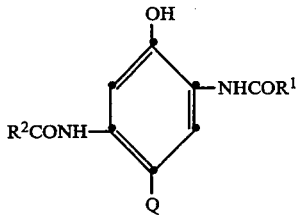

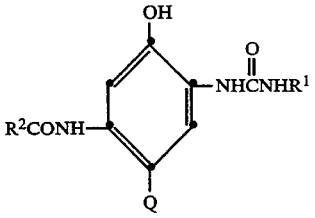

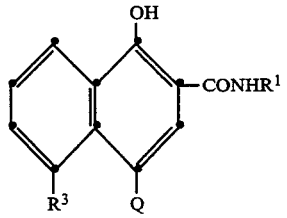

where $R^1$ and $R^2$ can represent a ballast group or a substituted or unsubstituted alkyl or aryl group, and $R^3$ represents one or more halogen (e.g., chloro, fluoro), alkyl having from 1 to 4 carbon atoms or alkoxy having from 1 to 4 carbon atoms. $R^4$ is hydrogen or a substituent that aids stabilization such as $NHCOOCH_2CH(CH_3)_2$. Q is hydrogen or a coupling-off group known in the photographic art.

Couplers which form magenta dyes upon reaction with oxidized color developing agent are described in such representative patents and publications as: U.S. Pat. Nos. 2,600,788; 2,369,489; 2,343,703; 2,311,082; 3,824,250; 3,615,501; 4,076,533; 3,152,896; 3,519,429; 4,062,653; 2,908,573; 4,540,654; European Patent Applications 285,274; 284,240 and 284,239; and "Farbkuppler: Eine Literaturübersicht", published in Agga Mitteilungen, Band III, pp. 126–156 (1961).

Preferably such couplers are pyrazolones and pyrazolotriazoles which form magenta dyes upon reaction with oxidized color developing agents at the coupling position, i.e. the carbon atom in the 4-position for pyrazolones and the 7-position for pyrazolotriazoles. Structures of such preferred magenta coupler moieties are:

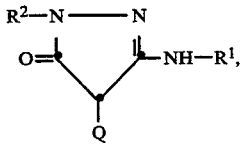

-continued

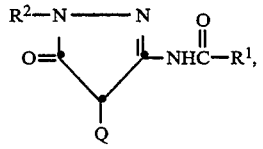

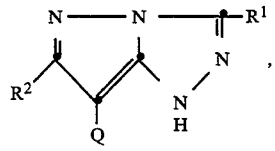

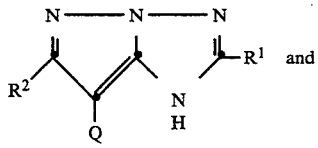

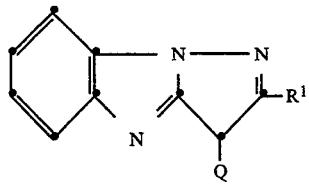

wherein $R^1$ and $R^2$ are as defined above; $R^2$ for pyrazolone structures is typically phenyl or substituted phenyl, such as for example 2,4,6-trihalophenyl, and for the pyrazolotriazole structures $R^2$ is typically alkyl or aryl. Q is as described.

Couplers which form yellow dyes upon reaction with oxidized color developing agent are described in such representative patents and publications as: U.S. Pat. Nos. 2,875,057; 2,407,210; 3,265,506; 2,298,443; 3,048,194; 3,447,928; and "Farbkuppler: Eine Literaturü bersicht," published in Agfa Mitteilungen, Band III, pp. 112–126 (1961).

Preferably such yellow dye-forming couplers are acylacetamides, such as benzoylacetanilides and pivalylacetanilides. These couplers react with oxidized developer at the coupling position, i.e. the active methylene carbon atom. Structures of such preferred yellow coupler moleties are:

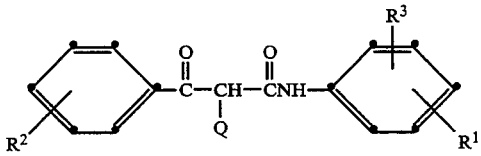

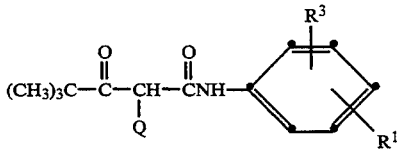

where $R^1$ and $R^2$ are as defined above and can also be hydrogen, alkoxy, alkoxycarbonyl, alkanesulfonyl, arenesulfonyl, aryloxycarbonyl, carbonamido, carbamoyl, sulfonamido, or sulfamoyl, $R^3$ is hydrogen or one or more halogen, lower alkyl (e.g. methyl, ethyl), lower alkoxy (e.g., methoxy, ethoxy), or a ballast (e.g. alkoxy of 16to 20 carbon atoms) group.

The term contamination herein means addition of a coupler whose dye formed upon exposure and processing of the element is of a different hue from the main image dye formed in the layer. For example, it is preferred that at least one of the blue-sensitive layers contain at least one cyan image-dye forming coupler, such as a phenolic cyan dye forming coupler as described in U.S. Pat. No. 4,333,999, the disclosure of which is incorporated herein by reference.

The contaminating coupler is added in a concentration that contaminating couplers have been added to photographic materials in the photographic art. Preferably the concentration of the contaminating coupler, such as the described cyan dye-forming coupler, in the yellow layer is within the range of 1.25 to 5.00 molar percent relative to the image dye forming coupler.

Any magenta colored masking coupler is useful in at least one of the blue-sensitive layers of the duplicating element as described. Such magenta colored masking couplers include, for example, known acetanilide magenta colored masking couplers, preferably

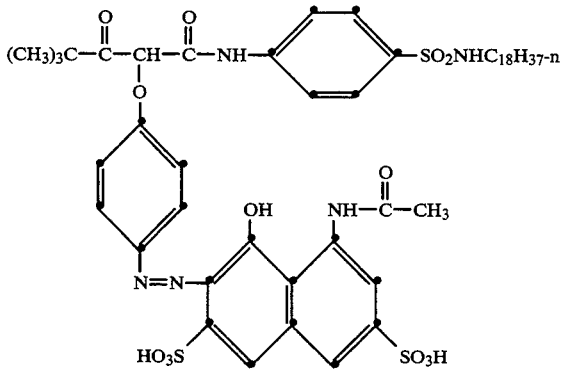

Other useful magenta colored masking couplers include, for example, those described in U.S. Pat. No. 3,476,536, and other naphtholic magenta color masking couplers known in the photographic art.

The magenta colored masking coupler is added in a concentration that enables correction of the unwanted green absorption of the yellow dye formed upon exposure and processing of the element. The concentration of the magenta colored masking coupler is preferably within the range of 1.25 to 5.00 molar percent relative to the image dye forming coupler.

A preferred duplicating element as described comprises a support, preferably a film support, bearing, in sequence:

(a) at least one red-sensitive photographic silver bromoiodide emulsion layer comprising a cyan image-dye forming coupler of the formula:

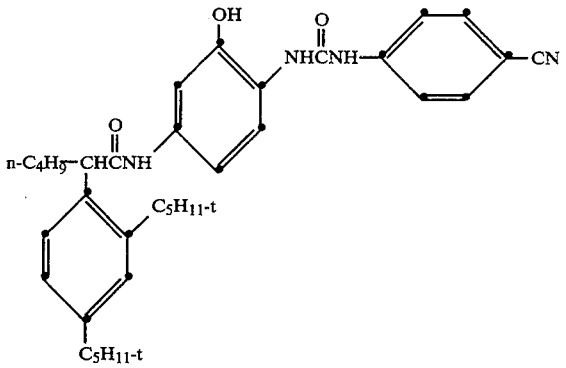

(b) at least one green-sensitive photographic silver bromoiodide emulsion layer comprising a combination of a major proportion of a magenta image-dye forming coupler of the formula:

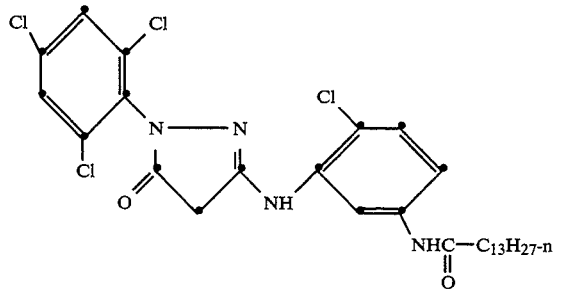

and a minor proportion of a magenta image-dye forming coupler of the formula:

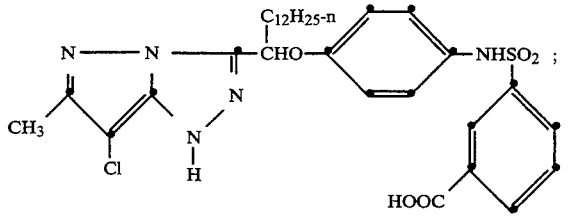

and (c) at least one blue-sensitive photographic silver bromoiodide emulsion layer comprising a yellow image-dye forming coupler of the formula:

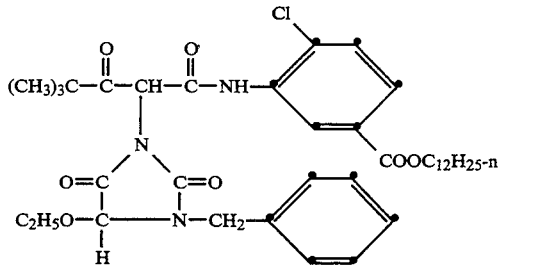

and a magenta colored masking coupler of the formula:

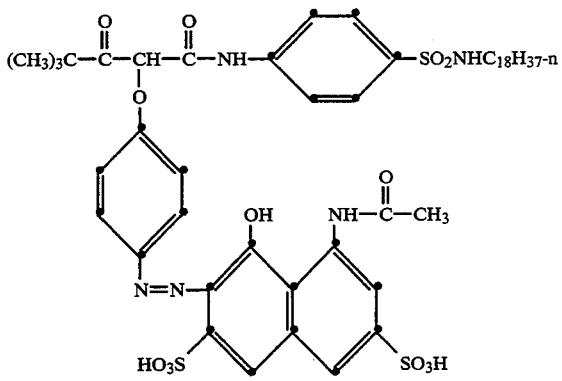

and a contaminating color coupler of the same formula at the cyan image-dye forming coupler; and wherein the photographic silver bromoiodide in each of the emulsion layers has a grain size within the range of 0.04 to 0.25 microns.

The couplers and other components of the described duplicating element can be prepared by methods known in the organic synthesis art and the photographic art.

The duplicating element as described can be exposed as described in Research Disclosure paragraph XVIII.

The duplicating element can be processed by compositions and processes known in the photographic art for processing duplicating elements, especially processes and compositions known for preparation of duplicates of motion picture films. A typical example of a useful process is the ECN-2 process of Eastman Kodak Company, U.S.A. and the compositions used in such a process. Such as process and compositions for such a process are described in, for example, "Manual for Processing Eastman Color Films-H-24" available from Eastman Kodak Co. Processing to form a visible dye image includes the step of contacting the exposed element with a color developing agent to reduce developable silver halide and oxidize color developing agent. Oxidized developing agent in turn reacts with the couplers to yield dye.

Any color developing agent is useful for processing the described duplicating element. Preferred color developing agents are described in, for example, U.S. Pat. No. 4,892,805 in column 17, the disclosure of which is incorporated herein by reference.

A preferred process and the preferred processing compositions for a photographic element of the invention are those that are known to be useful in the photographic motion picture film art for processing motion picture duplicating films.

The following examples further illustrate the invention.

EXAMPLE 1

Color Photographic Element of the Invention

A cellulose acetate film support was coated with the following layers, in sequence (the coverages given are in milligrams per meter squared):

Layer 1—Slow Cyan (232 as Ag) red sensitized cubic grain silver bromoiodide (3.5% iodide) gelatin emulsion.
0.042 micron grain size and chemically sensitized with sulfur and gold sensitizers.
(334) cyan dye forming coupler C-1.
(62) masking coupler MC-1.
(167) cyan absorber dyes
(3174) gelatin vehicle.

Layer 2—Mid Cyan (139 as Ag) red sensitized cubic grain silver bromoiodide (3.5% iodide) gelatin emulsion.
0.072 micron grain size chemically sensitized with sulfur and gold sensitizers.
(152) cyan image-dye forming coupler C-1.
(50) masking coupler MC-1.
(646) gelatin vehicle.

Layer 3—Fast Cyan (202 as Ag) 50% by weight red sensitized cubic grain silver bromoiodide (3.5% iodide) emulsion (0.136 micron grain size chemically sensitized with Sulfur and gold sensitizers) with 50% by weight red sensitized cubic grain silver bromoiodide (3.5% iodide) emulsion (0.091 micron grain size chemically sensitized with sulfur and gold sensitizers)..
(93) cyan image-dye forming coupler C-1.
(4.5) masking coupler MC-1
(780) gelatin vehicle.

Layer 4—Interlayer (699) gelatin vehicle
(269) DOX-1

Layer 5–Slow Magenta (339 as Ag) Green sensitized cubic grain silver bromoiodide (3.5% iodide) gelatin emulsion.
0.056 micron grain size chemically sensitized with sulfur and gold chemical sensitizers.
(291) magenta image-dye forming coupler M-1.
(80) masking coupler MC-2.
(100) magenta absorber dye.
(2582) gelating vehicle.

Layer 6—Mid Magenta (170 as Ag) Green sensitized cubic grain silver bromoiodide (3.5% iodide) emulsion. 0.080 micron grain size chemically sensitized with sulfur and gold chemical sensitizers.
(117) magenta image-dye forming coupler M-1.
(57) masking coupler MC-2.
(807) gelatin vehicle.

Layer 7—Fast Magenta (258 as Ag) Green sensitized cubic grain silver bromoiodide (3.5% iodide) emulsion. 0.115 micron grain size chemically sensitized with sulfur and gold chemical sensitizers.
(27) magenta image-dye forming coupler M-1.
(54) magenta image dye forming coupler M-2.
(14) masking coupler MC-2.
(753) gelatin vehicle.

Layer 8—Interlayer (699) gelatin vehicle.
(209) DOX-1
(81) yellow filter dye.

Layer 9—Slow Yellow (227 as Ag) 30% by weight blue sensitized cubic grain silver bromoiodide (3.5% iodide) emulsion. 0.115 micron grain size chemically sensitized with sulfur and gold chemical sensitizers and containing blue spectral sensitizer with 70% by weight blue sensitized cubic grain silver bromoiodide emulsion 0.091 micron grain size.

(803) yellow image-dye forming coupler Y-1.
(22) magenta color masking coupler M-3.
(16) cyan coupler C-1
(2313) gelatin vehicle.

Layer 10—Mid Yellow (162 as Ag) Blue sensitized cubic grain silver bromoiodide (3.5% iodide) emulsion. 0.145 micron grain size chemically sensitized with sulfur and gold chemical sensitizers and containing red spectral sensitizer.

(222) yellow image-dye forming coupler Y-1.
(11) magenta colored masking coupler MC-3.
(8) cyan coupler C-1
(699) gelatin vehicle.

Layer 11—Fast Yellow (226 as Ag) Blue sensitized cubic grain silver bromoiodide (3.5% iodide) emulsion. 0.197 micron grain size chemically sensitized with sulfur and gold chemical sensitizers and containing red spectral sensitizer.

(184) yellow image-dye forming coupler Y-1.
(12) magenta colored masking coupler MC-3.
(753) gelatin vehicle.

Layer 12—Blue Interlayer (915) gelatin vehicle.
(108) Lippmann silver.

Layer 13—Overcoat Layer (753) gelatin and matting agent.

The Y-1, MC-1, C-1, DOX-1, M-1, MC-2, M-2, and MC-3 are identified as follows:

Y-1

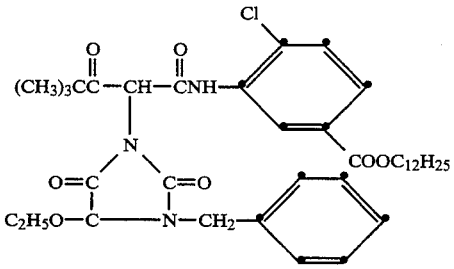

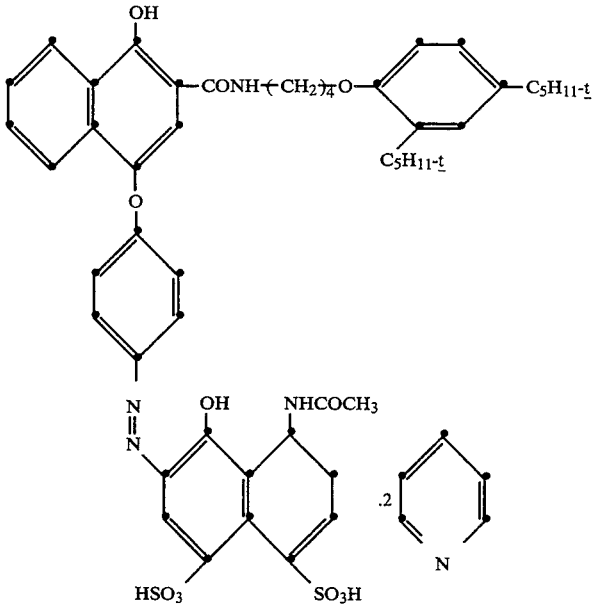

MC-1

-continued
C-1
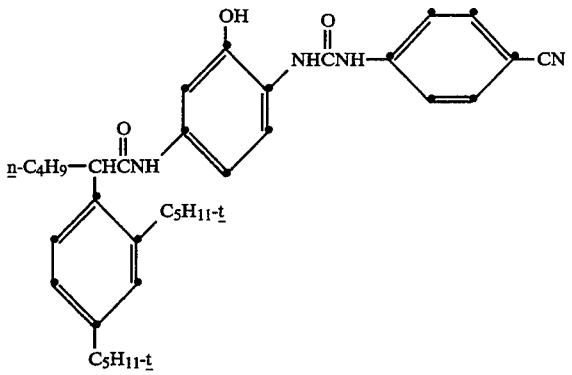
didodecylhydroquinone DOX-1
M-1
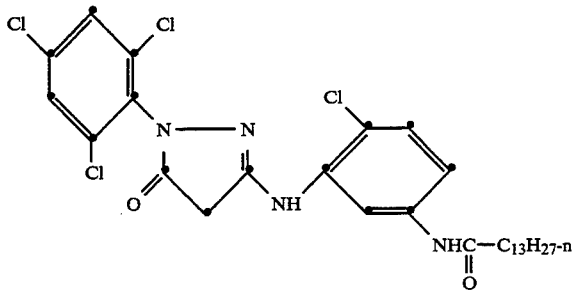
MC-2
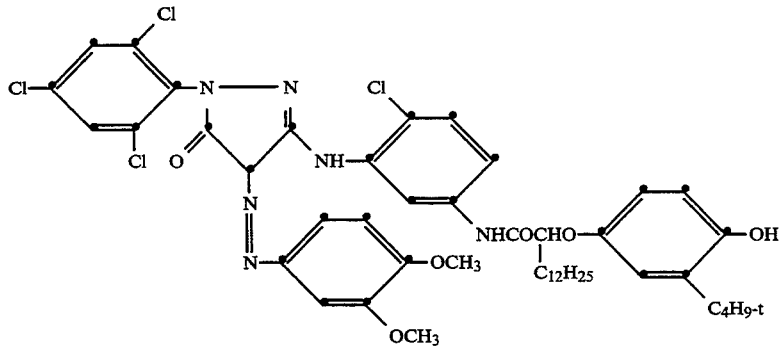
M-2
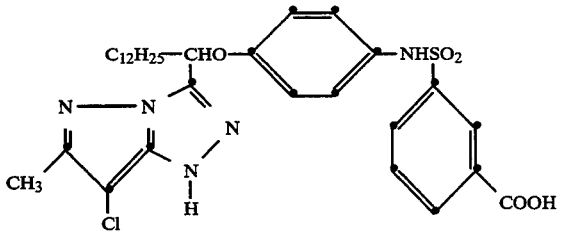

-continued

MC-3

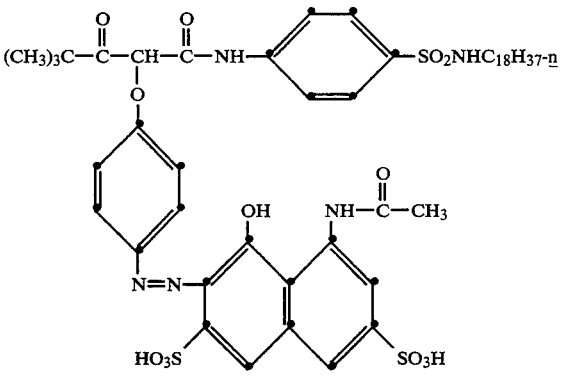

The described duplicating film of the invention was used in forming a color image as follows:

An original camera negative motion picture film (ON-1) (original color negative motion picture film) which was EI 100 35mm EXR Color Negative Film, No. 5248, (trademark of and commercially available from Eastman Kodak Co., U.S.A.) was imagewise exposed to a conventional Macbeth Color Rendition Chart containing colors of the visible spectrum. The Macbeth Color Rendition Chart is commercially available from Macbeth, a division of Kollmorgen Corporation, 2441N. Calbert St., Baltimore, Md., U.S.A. and is a trademark of Kollmorgen Corporation, U.S.A. The exposure provided a developable latent image in the ON-1 film. The exposed ON-1 film was then processed in a commercial Eastman Color Negative-2 development process (ECN-2 process commercially available from Eastman Kodak Co., U.S.A.). This ECN-2 process and the compositions for this process are described in, for example, "Manual for Processing Eastman Color Film—H-24", available from Eastman Kodak Company, Rochester, N.Y., U.S.A.

The described intermediate film (IF-1) of the invention was then imagewise exposed to light using the described processed original color negative film (ON-1). A latent image was formed in the intermediate film based on the image in the original color negative film. The imagewise exposed intermediate film was then processed in the same way using the same process (ECN-2) as described for the original color negative film.

The resulting processed intermediate film (IF-1) was then used to form a master positive film (MP-1) image. This master positive film was then printed again onto a second sample of the intermediate film of the invention (IF-2) as described above to provide a duplicate negative. The exposure steps and processing were essentially the same in each step as described for the exposure and processing of the original color negative film (ON-1).

Finally the duplicate negative (IF-2) (intermediate film of the invention) was printed onto Eastman Color Print Film (ECP-1) (commercially available from Eastman Kodak Co., U.S.A.) forming a release print. The exposure and processing of the Eastman Color Print film (ECP-1) was as commercially used for the ECP-2B process commercially available from Eastman Kodak Co. (The ECP-2B process is described in the above "Manual for Processing Eastman Color Films—H-24" available from Eastman Kodak Co., U.S.A.)

In a separate step for comparison purposes, a direct print (ECP-2) was formed by printing the camera negative film (ON-1) directly onto Eastman Color Print film. The colors in the color image in the first print film (ECP-1) made from the duplicate negative (IF-2) were visually indistinguishable under typical motion picture viewing conditions from the colors in the direct print (ECP-2) formed by printing the camera negative film directly onto Eastman Color Print film.

The invention has been described in detail with particular reference to preferred embodiments thereof, but it will be understood that variations and modifications can be effected within the spirit and scope of the invention.

What is claimed is:

1. A color photographic silver halide negative working duplicating element comprising a support bearing at least one red-sensitive photographic silver halide emulsion layer comprising at least one cyan dye forming coupler that is capable upon exposure and processing of forming a cyan dye; at least one green-sensitive photographic silver halide emulsion layer comprising at least one magenta dye forming coupler that is capable, upon exposure and processing, of forming a magenta dye; and at least one blue sensitive photographic silver halide emulsion layer comprising at least one yellow dye forming coupler that is capable upon exposure and processing of forming a yellow dye;

wherein the element additionally comprises (A) a magenta colored acetanilide masking coupler in at least one blue-sensitive photographic silver halide emulsion layer, in an amount of 1.25 to 5.00 molar percent of yellow dye forming coupler; and (B) a combination of (i) masking couplers and (ii) color contaminating coupler in at least one of the blue-sensitive photographic silver halide emulsion layers; said negative working duplicating element, upon exposing an original color negative onto a first sample of said negative working duplicating element, and processing, then printing the exposed and processed first sample of said negative working duplicating element onto a second sample of said negative working duplicating element, and processing, then printing the exposed and processed second sample of said negative working duplicating element onto a print film, and processing, will give a print image with colors that are visually indistinguishable from a direct print of the original color negative onto a second, identical, sample of said print film.

2. A color photographic silver halide negative working duplicating element as in claim 1 wherein the magenta colored masking coupler is:

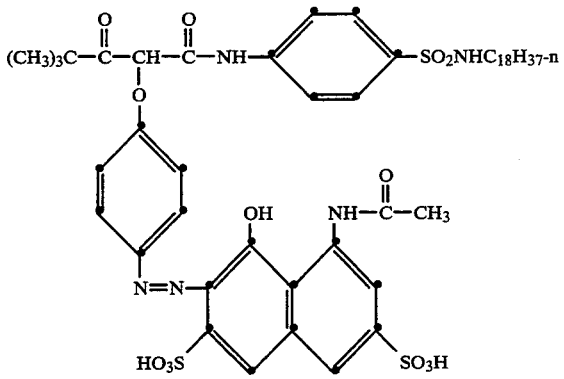

3. A color photographic silver halide negative working duplicating element as in claim 1 wherein the green-sensitive photographic silver halide emulsion layer comprises a combination of a major proportion of a pyrzolone magenta dye-forming coupler and a minor proportion of a pyrazolotriazole magenta dye-forming coupler; and, wherein the blue-sensitive photographic silver halide emulsion layer comprises a phenolic cyan dye forming coupler with a magenta colored masking coupler that is:

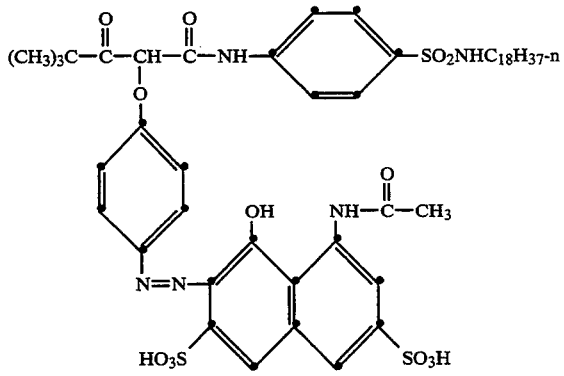

4. A color photographic silver halide negative working duplicating element as in claim 1 wherein the cyan dye forming coupler is a phenolic or naphtholic cyan dye forming coupler; the magenta dye forming coupler is a pyrazolone magenta dye forming coupler in combination with a pyrazolotriazole magenta dye forming coupler; and the yellow dye forming coupler is a pivalylacetanilide or benzoylacetanilide yellow dye forming coupler.

5. A color photographic silver halide negative working duplicating element as in claim 1 wherein the photographic silver halide in each of the red-sensitive, green-sensitive and blue-sensitive photographic silver halide emulsion layers is photographic silver bromoiodide having a grain size within the range of 0.04 to 0.25 microns.

6. A color photographic silver halide negative working duplicating element according to claim 1 comprising a support bearing, in sequence:

(a) at least one red-sensitive photographic silver bromoiodide emulsion layer comprising a cyan dye forming coupler of the formula:

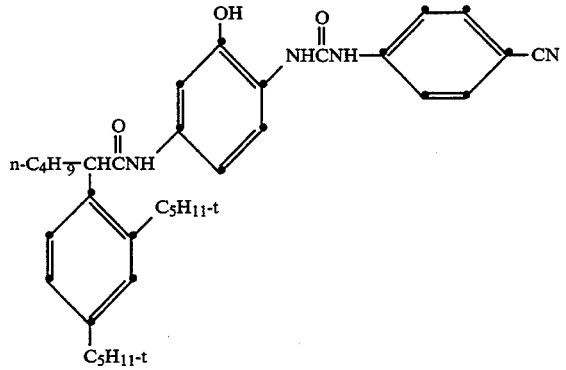

(b) at least one green-sensitive photographic silver bromoiodide emulsion layer comprising a combination of a major proportion of a magenta dye forming coupler of the formula:

M-1

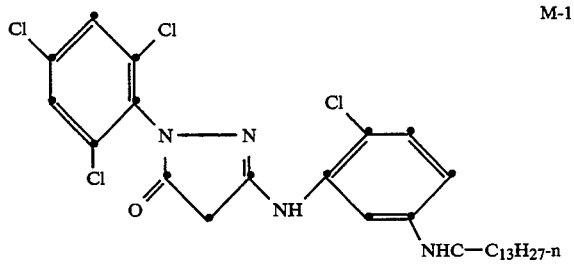

and a minor proportion of a magenta dye forming coupler of the formula:

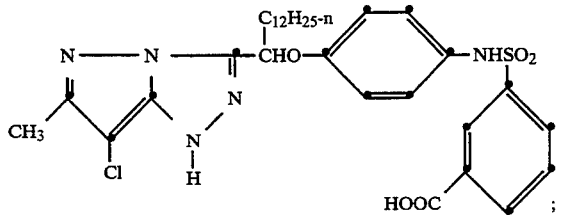

and (c) at least one blue-sensitive photographic silver bromoiodide emulsion layer comprising a yellow dye forming coupler of the formula:

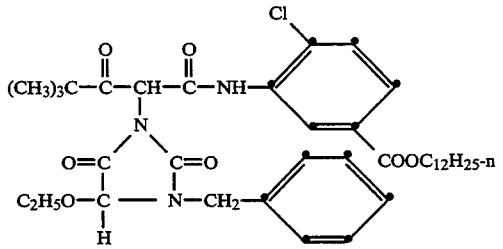

and a magenta colored masking coupler of the formula:

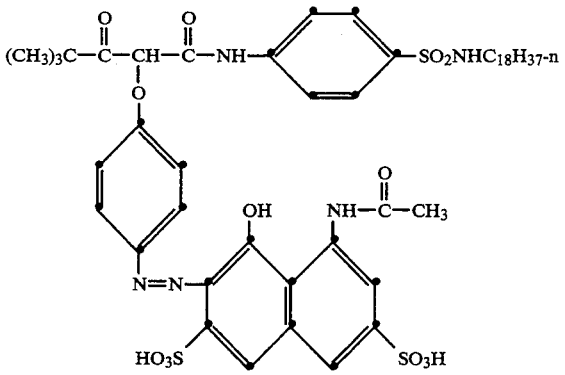

and a contaminating color coupler of the same formula as said cyan dye forming coupler; and wherein the photographic silver bromoiodide in each of the emulsion layers has a grain size within the range of 0.05 to 0.20 microns.

7. A color photographic silver halide negative working duplicating element as in claim 1 wherein each one of the red-sensitive, green-sensitive and blue-sensitive layers comprises a unit of three layers.

8. A color photographic silver halide negative working duplicating element as in claim 1, wherein the element is a motion picture duplicating element.

9. A color photographic silver halide negative working duplicating element as in claim 8 wherein the emulsions in each of the layers is comprised of silver bromoiodide grains which are cubic or tabular grains.

10. A color photographic silver halide negative working duplicating element as in claim 8 wherein the green-sensitive layer comprises a combination of a pyrazolone magenta dye forming coupler representing more than 50% by weight of the total magenta couplers and a pyrazolotriazole magenta dye forming coupler representing less than 50% by weight of all the magenta couplers.

* * * * *